US005922159A

United States Patent [19]

Cahill

[11] Patent Number: 5,922,159

[45] Date of Patent: Jul. 13, 1999

[54] INK JET IMAGING LAYER TRANSFER PROCESS

[75] Inventor: Douglas Allan Cahill, Belchertown, Mass.

[73] Assignee: Rexam Graphics, Inc., South Hadley, Mass.

[21] Appl. No.: 08/115,556

[22] Filed: Sep. 3, 1993

[51] Int. Cl.[6] ..... B44C 1/165

[52] U.S. Cl. ..... 156/239; 156/235; 156/246; 156/323; 156/324.4; 346/135.1; 427/152; 428/349

[58] Field of Search ..... 156/235, 239, 156/323, 324.4, 246; 428/349; 346/135.1; 427/152

[56] References Cited

U.S. PATENT DOCUMENTS

| | | | |
|---|---|---|---|
| 3,620,872 | 11/1971 | Backwell | 156/246 |
| 4,732,786 | 3/1988 | Patterson et al. . | |
| 4,775,594 | 10/1988 | Desjarlais . | |
| 4,902,577 | 2/1990 | Butters et al. | 346/135.1 |
| 5,126,195 | 6/1992 | Light . | |
| 5,217,773 | 6/1993 | Yoshida . | |
| 5,225,260 | 7/1993 | McNaul et al. . | |

OTHER PUBLICATIONS

Pp. 379–384 of W.E.Haas' Chapter 13, "Non–Impact Printing Technologies"; Imaging Processes and Materials—Neblette's Eighth Edition; Edited by J. Sturge, V. Walwroth, A. Shepp; Van Nostrand Reinhold, New York; 1989.

*Primary Examiner*—John J. Gallagher
*Attorney, Agent, or Firm*—Ratner & Prestia

[57] ABSTRACT

A method for the preparation of ink jet receptor elements that contain receptor layers on difficult to coat substrates is disclosed. An element that contains, in order, a carrier sheet, a receptor layer, and an adhesive layer is laminated to the substrate and the carrier sheet removed. Difficult to coat substrates include deformable substrates and porous substrates.

15 Claims, No Drawings

INK JET IMAGING LAYER TRANSFER PROCESS

FIELD OF THE INVENTION

This invention relates to ink jet imaging. In particular this invention relates to a method for preparing a receptor element for ink jet imaging.

BACKGROUND OF THE INVENTION

Unlike the image produced by conventional printing, an ink jet image is transferred to the image receptor without a great deal of force. Ink droplets are emitted from a nozzle and deposited on a receptor to form an image. Ink jet imaging is discussed by W. E. Hass, in *Imaging Processes and Materials—Neblette's Eight Edition*, J. Sturge, V. Walworth, and A. Shepp, Ed., van Nostrand Reinhold, New York, 1989, pp 379–384.

To obtain high quality images, the ink must be rapidly absorbed into the receptor so that little or no spreading of the droplet, with concurrent loss of resolution, occurs. Consequently, materials that are not absorptive, such as polymer films, are typically coated with an absorptive receptor layer to form ink jet receptor elements.

To avoid the problems associated with the use of organic solvents, ink jet receptor layers that can be coated from water or from mixtures of water and lower alcohols have been developed. Coating from organic solvents, especially chlorinated hydrocarbons, is frequently undesirable because of air pollution, solvent recovery, toxicity, and waste disposal considerations. Residual solvent also may remain in the coating and produce odor problems during use of the element.

Coating of the receptor layer onto certain types of substrates, especially deformable substrates and porous substrates, is difficult. Coating onto deformable substrates, such as static cling vinyl, i.e., untreated poly(vinyl chloride) about 50–150 micron thick, or onto adhesion backed vinyl, is difficult because the high temperature (about 120–125° C.) used for drying the coating can lead to distortion of the substrate and/or delamination of the substrate either from the coating or from associated layers. Use of lower drying temperatures produces to unacceptably low throughput for the coating equipment and/or unacceptable solvent residue in the receptor layer. Coating onto porous substrates, such as acrylic primed spunbonded polypropylene, is difficult because the material absorbs the coating solution. A need exists for a method for preparing ink jet receptor elements that comprise receptor layers on difficult to coat substrates, especially deformable substrates and porous substrates.

SUMMARY OF THE INVENTION

The invention is a method for preparing ink jet receptor elements that comprise receptor layers on difficult to coat substrates, the method comprising:

(1) laminating the adhesive layer of a transfer element to a deformable substrate or to a porous substrate, lamination being carried out at 110–130° C., the transfer element comprising, in order:
   (a) a dimensionally stable, removable carrier sheet;
   (b) an ink jet receptor layer, the ink jet receptor layer comprising 10–100% of a hydrophilic polymer; and
   (c) an adhesive layer, the adhesive layer consisting essentially of a thermal adhesive.

DETAILED DESCRIPTION OF THE INVENTION

Ink Jet Receptor Layer

The receptor layer is a hydrophilic layer that absorbs aqueous inks. It is water receptive and possess sufficient surface energy to to spread the ink droplets rapidly to obtain large dots.

The receptor layer comprises at least one hydrophilic polymer or resin. The polymer should be soluble, or at least dispersible, in aqueous based solvents so that the receptor layer may be coated from these solvents. Aqueous based solvents include: water; solvents that consist essentially of water; and mixtures of water and methanol and/or ethanol that contain at least 40% water, preferably at least 45%, water.

Suitable hydrophilic polymers and resins include, for example: poly(vinyl pyrrolidone), poly(vinyl alcohol), vinyl pyrrolidone/vinyl acetate copolymers, acrylic acid polymers and copolymers, acrylamide polymers and copolymers, cellulose derivatives, esterified maleic anhydride copolymers, gelatin and modified gelatin, etc, and mixtures thereof. Preferred hydrophilic polymers include: poly(vinyl pyrrolidone), poly(vinyl alcohol), hydroxyethyl cellulose, carboxyethyl cellulose and mixtures thereof.

Other ingredients that are conventional components of ink jet ink receptor layers may be present provided they are: compatible with the other ingredients; do not impart unwanted color to the element; and do not adversely affect the properties of the receptor layer and of the receptor element needed for the practice of the invention. Such properties include, for example, the transferability and ink acceptance of the receptor layer. These ingredients should also not adversely affect the image formed on the receptor layer by adversely affecting, for example, the color or permanence of the image. Such ingredients include, for example, particulate materials, dyes, pigments, pigment dispersants, antistat agents, plasticizers, etc.

Surface roughness can be obtained by including in the layer particles sufficiently large to give surface irregularities to the layer. Particles of diameter in the range of about 1–15 microns, preferably 1–5 microns, are suitable. Particle composition and size are chosen to give the appropriate surface topography and abrasive properties to the receptor layer.

Suitable particulate materials include inorganic particles of quartz, silica, chalk, calcium carbonate, magnesium carbonate, kaolin, calcined clay, gypsum, pyrophylite, bentonite, zeolites, barium sulfate, etc, and beads of polymers, such as poly(methyl methacrylate), methyl methacrylate/divinylbenzene copolymers, poly(styrene), vinyltoluene/t-butyl-styrene/methacrylic acid copolymers, etc. The particulate layer may also function as a pigment by providing opacity to the receptor layer.

The composition typically contains a surfactant or coating aid. Surfactants are compounds that typically include hydrophilic and hydrophobic groups. The hydrophobic group typically contains an organic moiety of 10 to 20 carbon atoms. The hydrophilic group typically contains a polyoxyethylene chain and/or an ionic group.

Numerous surfactants are known to those skilled in the art. Surfactants are discussed in *McCutcheon's Detergents and Emulsifiers*, Manufacturing Confectioners Publishing company, Glen Rock, N.J., and in *Encyclopedia of Surfactants*, Volumes I–III, Compiled by M. and I. Ash, Chemical Publishing Co., NY. Typical surfactants include non-ionic surfactants, such as the ethoxylates of alcohols and phenols, and anionic surfactants, such the sulfates of the ethoxylates of alcohols and phenols. Preferred surfactants are fluorosurfactants such as Fluorad® FC-430 (3M Company), especially anionic fluorosurfactants, such as Zonyl® FSJ (DuPont).

The receptor layer may also contain colorants, i.e, dyes and pigments, to produce the desired hue and opacity and to provide the desired background for the ink jet image image formed on the receptor layer.

The receptor layer may also comprise a water insoluble or hydrophobic polymer or resin, such as a highly styrenated acrylic, a styrene/allyl alcohol copolymer, nitrocellulose, a carboxylated resin, a polyester resin, a polyketone resin, or a poly(vinyl butyral) resin. These polymers impart a suitable degree of hydrophobicity and other desirable physical and chemical characteristics. Such layers are described in Desjarials, U.S. Pat. No. 4,775,594.

The receptor layer may also comprise non-volatile organic acids, such as methoxyacetic acid, glycolic acid, citric acid, malonic acid, tartaric acid, maleic acid, fumaric acid, malic acid, succinic acid, etc. These acids have been used to improve the wetting properties of the receptor layer. Such layers are described in Desjarials, U.S. Pat. No. 4,775,594. The receptor layer may also contain a plasticizer, such as glycerine, to prevent curl. Antistatic agents may also be added. Typical antistatic agents are quaternary ammonium compounds, such as the polymeric amine salts described in Sinkovitz, U.S. Pat. No. 4,148,639.

The composition of the receptor layer depends on the properties desired. The performance of the receptor layer depends on both the ink jet imaging device and the type of aqueous ink selected. Therefore, it is frequently necessary to optimize the receptor layer for each imaging device/ink jet ink combination chosen. The receptor layer typically comprises 10–100% hydrophilic polymer, 0–10% particulate material, 0–5% surfactant, and, if present, varying amounts of other ingredients as required by the properties desired for the receptor layer.

Adhesive Layer

The adhesive layer consists essentially of a thermal adhesive. Thermal adhesives are substantially tack-free at ambient temperature, but are activated at a temperature above the normal ambient temperature of the transfer element. Thermal adhesives are discussed in *Handbook of Adhesives*, 3rd. Edition, I. Skeist, ed., Van Vostrand Reinhold, New York, 1990.

Thermal adhesives are preferred because transfer elements containing a thermally activated adhesive can be stored in roll form without blocking. If pressure sensitive adhesive were used, the adhesive layer would have to be covered by a temporary coversheet to prevent blocking during storage.

The adhesive layer may be chosen from a variety of conventional thermal adhesive materials, such as: thermoplastic polyurethanes polycaprolactone; acrylic copolymers; poly(vinyl acetate); ethylene/vinyl acetate copolymers; and combinations thereof.

Representative thermal adhesives include Morthane® CA-116 urethane resin (Morton International); Silaprene® polyurethane adhesives (Uniroyal); Tones® Polymer P767E biodegradable plastic resin (Union Carbide); Elvax® 240 vinyl resin (DuPont); and the like. Preferred thermally activated adhesives include polyurethanes adhesives. These materials are especially well suited for transfer to poly(vinyl chloride) films.

Carrier Sheet

The removable carrier sheet serves as a support for the transfer element during manufacture, storage and manipulation prior to lamination to the substrate. It may be any web or sheet material possessing suitable flexibility, dimensional stability and adherence properties to the ink jet receptor layer. Typically, the carrier sheet is a web or sheet of flexible polymeric film, such as, poly(ethylene), poly(propylene), or poly(ethylene terephthalate); or a foraminous material, such as a paper sheet.

The adherence of the removable carrier sheet to the receptor layer must be substantially less than the adherence of the both the substrate and the receptor layer to the adhesive layer so that-the carrier sheet can be peeled off of the receptor layer following lamination of the adhesive layer to the substrate and prior to imaging of the receptor layer. To enhance release characteristics, the carrier sheet may be treated or coated with a material to enhance release characteristics, such as a silicone release agent. Paper, for example, must be surface treated to have the proper release characteristics. Surface treatment is not required for polymer films.

A preferred material for the carrier sheet is untreated poly(ethylene terephthalate) film. While film thickness is not critical, the film should be of sufficient thickness to provide dimensional stability to the transfer element during the coating and transfer processes and to be removable without tearing following lamination of the transfer element to the substrate. Films of about 50–250 microns thick, preferably 75 to 150 microns thick, may be used.

Substrate

The substrate is a difficult to coat material, typically a deformable or porous web or sheet material. Deformable substrates are frequently used to produce images that will conform to irregularly shaped objects, such as windshields, the sides of a trucks or other vehicles, brick walls, etc. Porous substrates are used to prepare signs, banners, packaging, etc.

Poly(vinyl chloride) film about 50–150 micron thick, commonly known as cling vinyl or static cling vinyl is a deformable substrate. After transfer of a receptor layer, this material can be imaged to produce images for stickers for automobile windows, decals, backlit applications, etc.

Another deformable substrate is poly(vinyl chloride) film bearing on one side a layer of pressure sensitive adhesive covered with a release liner. This material can be used to prepare bumper stickers and other adherent signs, such as for fleet graphics. Extremely thin or tissue-like substrates are also deformable substrates.

Sign and banner material is not only deformable but is also porous. Porous substrates are difficult to coat because the material absorbs the coating solution. Typical sign and banner materials include: acrylic primed spun bonded poly (propylene); acrylic primed spun bonded poly(ethylene); extrusion coated high density poly(ethylene) weave; vinyl reinforced polyester; top coated vinyl reinforced polyester; two sided vinyl reinforced polyester; vinyl reinforced glass cloth; poly(ethylene); cotton drill; acrylic coated cotton; and equivalent materials known in the art. Other porous substrates include corrugated materials, such as cardboard; chipboard; and other porous packaging materials.

Preparation of the Transfer Element

The coating solution for the receptor element may be prepared by adding the ingredients to the appropriate solvent and agitating the resulting mixture until all the ingredients are either in solution or suspension. As is well known to those skilled in the art, coating solution refers to the mixture of coating solvent and additives that is coated on the carrier sheet, even though some of the additives may be suspended solids rather than in solution. Water; solvents that consist essentially of water; and mixtures of water and methanol and/or ethanol that contain at least 40% water, preferably at least 45% water, are preferred. This avoids many of the problems associated with organic solvents and the problems caused by residual solvent in the receptor layer.

The coating solution is about 15–25%, preferably about 20%, total solids. As is well known, total solids refers to the total amount of non-volatile materials in the coating solution, even thought some of the materials may be liquids at ambient temperature. Dry coating thickness for the receptor layer is about 6–13 microns, preferably about 8–10 microns.

The receptor layer is normally applied to the carrier sheet while it is in web form using any appropriate web-coating method, such as bar coating, blade coating, reverse roll coating, wire rod coating, offset gravure coating, and extrusion die or slot die coating. In wire rod coating the carrier sheet is coated with the coating solution and the excess solution metered off by dragging the coated carrier sheet across a wire wrapped rod. A Meyer rod is a typical example of this device. Following coating the coated carrier sheet is dried to remove the solvent. Typical drying conditions are about 110–125° C. for about 1–10 minutes. It is especially important that the receptor layer be a smooth, continuous, extremely uniform, flaw free coating. Thin spots, pinholes, or coating skips in the receptor layer can adversely affect the quality of the image produced when the receptor layer is imaged.

Transfer

The adhesive layer is contacted and adhered to the substrate using applied heat and pressure to form a laminate comprising: carrier sheet, receptor layer, adhesive layer, and substrate. Heat is applied to the adhesive layer prior to and/or concurrently with the application of the applied pressure. While the temperature used to activate the adhesive depends on the adhesive, the transfer element is applied to the substrate at a temperature of about 80° C. or greater and preferably about 100° C. or greater. Typical application temperatures range from about 100° C. to about 150° C., preferably 110–130° C. The transfer element is typically applied to the substrate under an applied cylinder pressure of about $3.4\times10^5$ Pa to $6.9\times10^5$ Pa (50–100 psi) or greater.

Suitable means that may be used for lamination include: platen presses; counterpoised, double roll, laminating devices; scanning, single roll, laminating devices; hand-held, rollers and squeegees; etc. Typically roll laminating devices are preferred since they minimize air entrapment between the adhesive layer and the substrate. Vacuum may be applied with such devices to further eliminate air entrapment.

Following lamination, the carrier sheet is removed from the laminate. In this step, the carrier sheet is peeled, using a peel force, from the surface of the ink jet receptor layer to leave the receptor element comprising receptor layer, adhesive layer, and substrate. Typically, the carrier sheet is peeled at room temperature with a peel force directed at an angle of 90° or more from the surface of the ink jet receptor layer. The peel rate and the peel force are not critical and preferred values will depend on the nature of the materials. While the carrier sheet typically is removed at room temperature, the laminate may be heated to facilitate removal.

The carrier sheet may be removed immediately following formation of the laminate or may be left in place until the element is ready to be imaged. For some applications it may be advantageous to remove to carrier sheet in an online process immediately following the drying step. In this manner the carrier sheet may be removed in a continuous process and, if desired, wound on a roll for reuse. For other applications in may be advantageous to leave to carrier sheet on the receptor layer until the element is ready to be imaged. The carrier sheet serves to protect the receptor layer during transportation, storage and handling prior to imaging.

Imaging of the Receptor Element

The ink jet receptor element may be imaged by any of the conventional aqueous ink jet printers used to print single color or full color images. Conventional devices include, for example, the Hewlett Packard Desk Jet® ink jet printers, the Lexmark® ink jet printer, the Canon bubble jet ink jet printer, and the Encad Novajet® ink jet printer. The receptor element is imaged following the manufacture's recommended conditions and using the manufacture's recommended inks.

Industrial Applicability

The invention provides a method for the manufacture of receptor elements for ink jet imaging in which the ink jet receptor layer is adhered to a deformable or to a porous substrate. The process allows the application of the receiver layer to these substrates without the need for conventional coating equipment and possible accompanying environmental restrictions.

The elements can be used to prepare, distortion-free, full-color ink jet images on deformable or on porous substrates. These images can be as bumper stickers; signs for commercial vehicles, such as fleet graphics; large format posters; packaging material; billboards, etc.

The advantageous properties of this invention can be observed by reference to the following examples which illustrate, but do not limit, the invention.

EXAMPLES

| GLOSSARY | |
|---|---|
| Gohsenole ® T-330H | Poly(vinyl alcohol), 99–100% hydrolyzed; Nippon Gohsei, Japan |
| Hi-Sil ® T-600 | Amorphous silica, average particle size, 1.4 micron; PPG, Pittsburgh, PA |
| Imsil ® A-10 | Amorphous silica, average particle size, 2.2 microns; Illinois Minerals, Cairo, IL |
| Joncryl ® 61LV | Acrylic resin solution (34% solids); S. C. Johnson, Racine, WI |
| Morthane ® CA-116 | Hydroxyl terminated polyurethane elastomer; Morton Thiokol, Chicago, IL |
| PVP K-90 | Poly(vinyl pyrrolidone), MW (viscosity average) 700,000; GAF Chemicals, Wayne, NJ |
| Syloid ® 620 | Amorphous silica, average particle size 15 microns; Davidson Chemical, Baltimore, MD |
| Typar ® spunbonded polypropylene fabric | Spunbonded polypropylene fabric with an acrylic based primed surface; Eastern Banner Supply, Mooresville, IN |
| Zonyl ® FSJ | Anionic fluorosurfactant; Dupont, Wilmington, DE |

Example 1

This example illustrates preparation of a receptor element for ink jet imaging using a deformable substrate.

Ink Receptor Layer

A coating solution containing the following ingredients was prepared by adding the ingredients in the order listed to a Lightnin® mixer at medium agitation speed and stirring until all the ingredients were fully incorporated (1 hr).

| Ingredient | Parts by weight |
|---|---|
| Ethanol | 46.242 |
| Deionized water | 31.136 |
| Joncryl ® 61LV | 11.610 |
| PVP K-90 | 8.770 |
| Glycerine | 2.152 |
| Syloid ® 620 | 0.067 |
| Zonyl ® FSJ | 0.023 |

The solution was coated onto about 100 micron thick untreated poly(ethylene terephthalate) film using a #38 Meyer rod. The resulting element was dried at about 121° C. for 2 min. The dried receptor layer was about 9 micron thick.

Adhesive Layer

A coating solution containing the following ingredients was prepared by mixing the 2-butanone, toluene, and Morthane® CA-116 together in a high speed Lightning® mixer for 0.5 hr. Amorphous silica was added and mixing continued for 5 min.

| Ingredient | Parts by weight |
|---|---|
| 2-Butanone | 77.96 |
| Toluene | 10.00 |
| Morthane ® CA-116 | 12.00 |
| Amorphous silica[a] | 0.04 |

[a]Average particle size 3 microns

Transfer Element

The adhesive layer coating solution was overcoated onto the ink receptor layer using a #8 Meyer rod. The resulting element was dried at about 121° C. for about 2 min. The adhesive layer was about 2 microns thick.

Receptor Element

The transfer element, consisting of, in order, poly (ethylene terephthalate) film, receptor layer, and adhesive layer, was passed through a hot roll laminator with the adhesive layer in contact with a sheet of untreated cast vinyl with a pressure sensitive adhesive covered with a release liner on the opposite side (Rexcal® 4000 adhesive backed vinyl; Rexam Branded Products, Lancaster, S.C.). Laminating conditions were about 121° C., about $6.9\times10^5$ Pa (100 psi) cylinder pressure, and at about 1 cm/sec. The carrier sheet was removed within 10 sec of leaving the hot nip exposing the receptor layer.

The resulting ink jet receptor element, consisting of receptor layer, adhesive layer, cast vinyl, pressure sensitive adhesive, and release liner, was imaged with a Lexmark® color ink jet printer using IBM 4079 inks and standard imaging conditions.

Example 2

This example illustrates preparation of a receptor element for ink jet imaging using a banner material as a porous substrate.

A coating solution containing the following ingredients was prepared by adding the ingredients in the order listed to a Lightnin® mixer at medium agitation speed and stirring until all the ingredients were fully incorporated (0.5 hr).

| Ingredient | Parts by weight |
|---|---|
| 10% Gohsenol ® T-330H in water | 89.97 |
| 10% PVP K-90 in water | 9.97 |
| Imsil ® A-10 | 0.03 |
| Hi-Sil ® T600 | 0.03 |

The solution was coated onto about 100 micron thick untreated poly(ethylene terephthalate) film using a #38 Meyer rod. The resulting element was dried at about 121° C. for 2 min. The dried receptor layer was about 10 micron thick.

Following the procedure of Example 1, the transfer element, consisting of carrier sheet, receptor layer, and adhesive, was prepared. The transfer element was passed through the nip of an IT 6000 hot roll laminator so that the adhesive layer was in contact with the primed surface of a Typar® spunbonded polypropylene fabric. Laminating conditions were: temperature, about 121° C.; speed, 1 cm/sec; pressure, $3.45\times10^5$ Pa (50 psi) cylinder pressure.

The carrier sheet was removed after the laminated exited the laminator to leave a receptor element consisting of receptor layer, adhesive layer, and a substrate of primed of Typar® spunbonded polypropylene fabric. The receptor element was imaged with a Lexmark® Ink Jet printer using the manufacturer's recommended inks and imaging conditions to give a high quality four color image.

Example 3

The procedure of Example 1 was repeated except that the substrate was 0.0055 in (about 140 micron) thick static cling vinyl (Flexmark® CV600W, Flexcon).

Having described the invention, we now claim the following and their equivalents.

What is claimed is:

1. A method for preparing an ink jet image that comprises an ink jet receptor layer on a difficult to coat substrate, the method comprising:

(1) laminating the adhesive layer of a transfer element to a deformable substrate or to a porous substrate, the lamination being carried out at 100–150° C., the transfer element comprising, in order:
  (a) a dimensionally stable, removable carrier sheet;
  (b) an ink jet receptor layer, the ink jet receptor layer comprising 10–100% of a hydrophilic polymer; and
  (c) an adhesive layer, the adhesive layer consisting essentially of a thermal adhesive;

(2) removing the carrier sheet to form a receptor element, the receptor element comprising, in order:
  (b) the ink jet receptor layer,
  (c) the adhesive layer, and
  (d) the substrate; and (3) imaging the ink jet receptor layer to form the ink jet image.

2. The method of claim 1 wherein the carrier sheet is poly(ethylene terephthalate).

3. The method of claim 2 wherein the adhesive is selected from the group consisting of thermoplastic polyurethanes; polycaprolactone; acrylic copolymers; poly(vinyl acetate); ethylene/vinyl acetate copolymers; and combinations thereof.

4. The method of claim 1 wherein the hydrophilic polymer is selected from the group consisting of poly(vinyl pyrrolidone), poly(vinyl alcohol), vinyl pyrrolidone/vinyl acetate copolymers, acrylic acid polymers and copolymers, acrylamide polymers and copolymers, cellulose derivatives, esterified maleic anhydride copolymers, gelatin and modified gelatin, etc, and mixtures thereof.

5. The method of claim 4 wherein the substrate is selected from the group consisting of poly(vinyl chloride) film, acrylic primed spun bonded poly(propylene); acrylic primed spun bonded poly(ethylene); extrusion coated high density poly(ethylene) weave; vinyl reinforced polyester; top coated vinyl reinforced polyester; two sided vinyl reinforced polyester; vinyl reinforced glass cloth; poly(ethylene); cotton drill; acrylic coated cotton; cardboard; and chipboard.

6. The method of claim 5 wherein the hydrophilic polymer is selected from the group consisting of poly(vinyl pyrrolidone), poly(vinyl alcohol), hydroxyethyl cellulose, carboxyethyl cellulose and mixtures thereof.

7. The method of claim 6 wherein the adhesive is a polyurethane.

8. A method for preparing an ink jet image that comprises an ink jet receptor layer on a difficult to coat substrate, the method comprising, in order:

(1) coating onto a dimensionally stable carrier sheet a coating solution comprising a hydrophilic polymer in a solvent selected from the group consisting of water, solvents that consist essentially of water, and mixtures of (a) water and (b) methanol or ethanol that contain at least 40% water; the hydrophilic polymer comprising 10–100% of the solids in the coating solution; the coating forming an ink jet receptor layer;

(2) drying the resulting element at 110–130° C.;

(3) coating a layer of thermal adhesive onto the receptor layer;

(4) drying the resulting element;

(5) laminating the layer of thermal adhesive to a deformable substrate or to a porous substrate, lamination being carried out at 110–130° C., to form an element comprising in order: carrier sheet, receptor layer, adhesive layer, and substrates;

(6) removing the carrier sheet to form a receptor element, the receptor element comprising, in order:

(b) the ink jet receptor layer, (c) the adhesive layer, and (d) the substrate; and imaging the ink jet receptor layer to form the ink jet image.

9. The method of claim 8 wherein the carrier sheet is poly(ethylene terephthalate).

10. The method of claim 8 wherein the adhesive is selected from the group consisting of thermoplastic polyurethanes; polycaprolactone; acrylic copolymers; poly(vinyl acetate); ethylene/vinyl acetate copolymers; and combinations thereof.

11. The method of claim 8 wherein the hydrophilic polymer is selected from the group consisting of poly(vinyl pyrrolidone), poly(vinyl alcohol), vinyl pyrrolidone/vinyl acetate copolymers, acrylic acid polymers and copolymers, acrylamide polymers and copolymers, cellulose derivatives, esterified maleic anhydride copolymers, gelatin and modified gelatin, etc, and mixtures thereof.

12. The method of claim 8 wherein the substrate is selected from the group consisting of poly(vinyl chloride) film, acrylic primed spun bonded poly(propylene); acrylic primed spun bonded poly(ethylene); extrusion coated high density poly(ethylene) weave; vinyl reinforced polyester; top coated vinyl reinforced polyester; two sided vinyl reinforced polyester; vinyl reinforced glass cloth; poly (ethylene); cotton drill; acrylic coated cotton; cardboard; and chipboard.

13. The method of claim 12 wherein the hydrophilic polymer is selected from the group consisting of poly(vinyl pyrrolidone), poly(vinyl alcohol), hydroxyethyl cellulose, carboxyethyl cellulose and mixtures thereof.

14. The method of claim 13 wherein the adhesive is a polyurethane.

15. The method of claim 14 wherein the carrier sheet is poly(ethylene terephthalate) and the adhesive is selected from the group consisting of thermoplastic polyurethanes; polycaprolactone; acrylic copolymers; poly(vinyl acetate); ethylene/vinyl acetate copolymers; and combinations thereof.

* * * * *